US010465997B2

(12) United States Patent
Riondet

(10) Patent No.: US 10,465,997 B2
(45) Date of Patent: Nov. 5, 2019

(54) COLLECTING PLATE FOR A HEAT EXCHANGER, IN PARTICULAR FOR A MOTOR VEHICLE

(71) Applicant: Valeo Systemes Thermiques, Le Mesnil Saint Denis (FR)

(72) Inventor: Christian Riondet, Saint-Denis (FR)

(73) Assignee: Valeo Systemes Thermiques, Le Mesnil Saint Denis (FR)

( * ) Notice: Subject to any disclaimer, the term of this patent is extended or adjusted under 35 U.S.C. 154(b) by 0 days.

(21) Appl. No.: 15/575,664

(22) PCT Filed: May 20, 2016

(86) PCT No.: PCT/EP2016/061371
§ 371 (c)(1),
(2) Date: Nov. 20, 2017

(87) PCT Pub. No.: WO2016/188882
PCT Pub. Date: Dec. 1, 2016

(65) Prior Publication Data

US 2018/0283806 A1 Oct. 4, 2018

(30) Foreign Application Priority Data

May 22, 2015 (FR) ..... 15 54659

(51) Int. Cl.
*F28F 9/02* (2006.01)

(52) U.S. Cl.
CPC ..... *F28F 9/0226* (2013.01)

(58) Field of Classification Search
CPC ..... F28F 9/04; F28F 9/16; F28F 9/162; F28F 9/18; F28F 2009/0285
USPC ..... 165/173, 178
See application file for complete search history.

(56) References Cited

U.S. PATENT DOCUMENTS 4,305,459 A * 12/1981 Nonnenmann ..... F28F 9/0226 165/173
4,625,793 A * 12/1986 Cadars ..... F28F 9/0224 165/151
5,490,560 A * 2/1996 Helms ..... F28F 9/0226 165/153
6,988,544 B2 1/2006 Ozaki et al.
(Continued)

FOREIGN PATENT DOCUMENTS

FR 2 764 054 A1 12/1998
FR 2 764 054 B1 8/1999
(Continued)

OTHER PUBLICATIONS

International Search Report of the International Searching Authority issued in PCT/EP2016/061371 dated Sep. 12, 2016 (2 pages).
(Continued)

*Primary Examiner* — Allen J Flanigan
(74) *Attorney, Agent, or Firm* — Osha Liang LLP

(57) ABSTRACT

The invention relates to a collecting plate (10) having an inner face (12) and an outer face (14) of a heat exchanger, comprising at least three collars (16, 16*a*) arranged in a row so that each collar receives a tube (18). The two end collars (16*a*) of the row of collars protrude from the inner face (12) of the collecting plate (10), while at least one of the other collars (16) protrudes from the outer face (14) of the collecting plate (10).

13 Claims, 3 Drawing Sheets

(56) References Cited

U.S. PATENT DOCUMENTS

Figure 1:
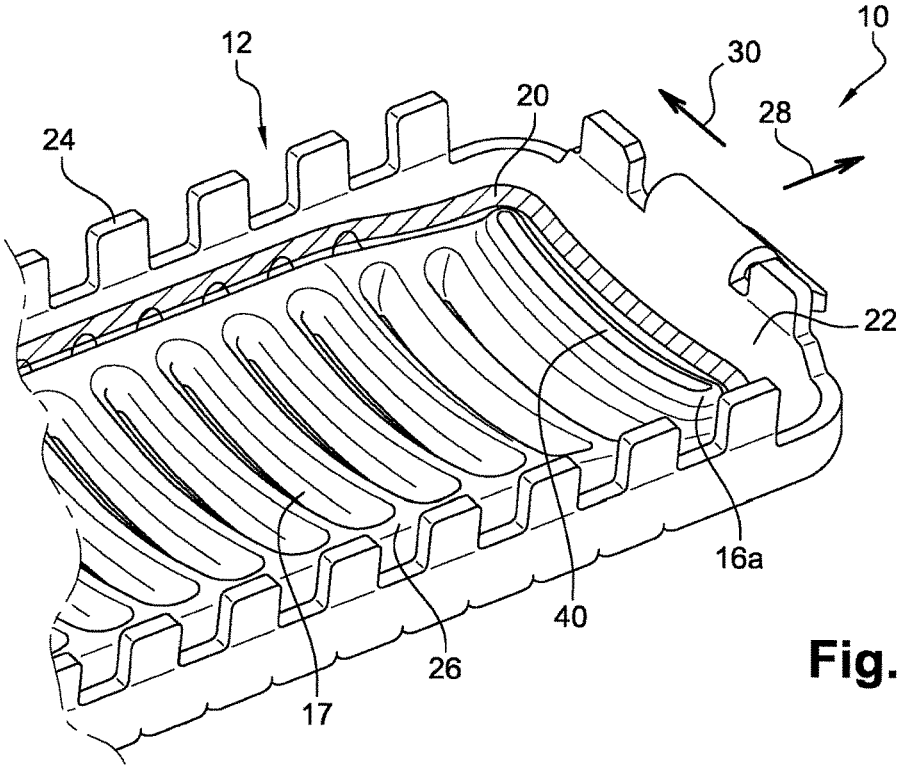

| | | | | |
|---|---|---|---|---|
| 7,237,605 | B2 * | 7/2007 | Ozaki | F28D 1/05366 165/149 |
| 2007/0235175 | A1 * | 10/2007 | DeGroot | F28F 9/02 165/173 |
| 2008/0000626 | A1 * | 1/2008 | Sugito | F28D 1/05366 165/173 |
| 2010/0282449 | A1 * | 11/2010 | Merklein | F28F 9/0226 165/158 |
| 2013/0160973 | A1 * | 6/2013 | Riondet et al. | F28F 9/0224 165/104.19 |
| 2014/0196876 | A1 * | 7/2014 | Riondet | F28F 9/001 165/173 |

FOREIGN PATENT DOCUMENTS

| | | | |
|---|---|---|---|
| FR | 2 938 052 | A1 | 5/2010 |
| FR | 2 977 932 | A1 | 1/2013 |
| WO | 2012/026664 | A1 | 3/2012 |

OTHER PUBLICATIONS

Written Opinion of the International Searching Authority issued in PCT/EP2016/061371dated Sep. 12, 2016 (4 pages).

* cited by examiner

COLLECTING PLATE FOR A HEAT EXCHANGER, IN PARTICULAR FOR A MOTOR VEHICLE

The invention relates more particularly to a heat exchanger such as a radiator for engine coolant, conventionally comprising a row of tubes interposed with corrugated fins and a collecting plate. The collecting plate which is generally produced from aluminum by a stamping method has a specific number of holes, each surrounded by a collar. The term "collar" denotes in this case a ring of material which protrudes from the collecting plate as a result of the procedure for producing the holes, generally by piercing, during which the plate is punctured without the removal of material. Each of the holes is capable of receiving a tube from the row of tubes, one end thereof coming into contact with the internal wall of the collar.

The collecting plate is often capped by a cover so as to form a collecting tank comprising a chamber traversed by a fluid which also circulates in the row of tubes. Thus it is able to distribute liquid to the tubes and/or collect liquid from the tubes. A peripheral gasket is arranged between the collecting plate and the cover to provide the seal of the collecting tank. The positioning of the peripheral gasket varies according to the structure of the collecting plate. There are two broad categories of collecting plates: so-called "flat" collecting plates and so-called "grooved" collecting plates. As their name indicates, the flat collecting plates have a generally flat structure which does not have any pronounced positive or negative raised portions other than the collars. For example, these are the plates disclosed in the patent application FR-2 977 932 in the name of the applicant. In contrast, the grooved collecting plates, such as those disclosed in the U.S. Pat. No. 6,988,544, have a peripheral groove extending outside the principal plane from which the collars are produced. A variant of so-called "grooved collecting plates with flat ends" exists within the category of grooved collecting plates. The peripheral groove of these collecting plates is not present or has a small depth at the ends in the direction of the length of the collecting plate. In conventional grooved collecting plates where the groove has a sufficient depth, the peripheral gasket is placed in the peripheral groove designed to receive said gasket. In the case of flat collecting plates or grooved collecting plates with flat ends, the seal ring is principally borne by the tubes furthest to the outside of the row of tubes.

The tubes are generally inserted in the same direction as the direction of advance of the piercing tool. During the insertion of the tubes, said tubes are introduced slightly beyond the collar into the inside of the chamber of the collecting tank in order to ensure brazing or welding of sufficient quality between the tube and the collar. More specifically, the presence of the collar permits a greater surface to be provided for the brazing or welding of the tube than a simple slot. This also permits risks of leakage to be avoided. However, the projection of a part of the tube into the heat exchanger may lead to a loss of pressure in the circulation of the fluid. Moreover, this projection, generally by approximately 10 mm, is all the more significant for the end tubes of the row of tubes since the collecting plate is often not flat and is generally convex in the center and the tubes are usually of the same length. This reduction in pressure which has been produced has to be compensated, therefore, by additional force of the pump to ensure a uniform flow of the fluid within the entire circuit.

To remedy these drawbacks, the patent FR-2 764 054 of the applicant discloses a heat exchanger which comprises a collecting plate with "reverse collars". More specifically, the tubes are inserted into the collecting plate on the side of the collars, i.e. in the direction opposing the direction of the formation of holes by piercing. In this case, a sufficient surface exists for brazing or welding between the collars and the tubes without a projection of the tubes, or with a reduced projection of the tubes, into the chamber of the collecting tank. The losses of pressure are thus reduced. However, the "reverse collars" have drawbacks. Firstly, since the collars are oriented toward the outside of the collecting tank the insertion of the tubes into the collecting plate is more difficult due to a smaller opening and the absence of guidance for the tubes for penetrating into the collars. Secondly, since the tubes no longer sufficiently project into the chamber of the collecting tank, the internal surface of the collecting plate does not have a raised portion which is able to bear the seal ring. Further means are, therefore, necessary to bear the gasket.

The object of the invention, in particular, is to provide a heat exchanger which is improved in terms of loss of pressure and which remedies at least one of these drawbacks.

To this end, the subject of the invention is a collecting plate having an inner face and an outer face of a heat exchanger, comprising at least three collars arranged in a row so that each collar receives a tube, characterized in that the two end collars of the row of collars protrude from the inner face of the collecting plate, while at least one of the other collars protrudes from the outer face of the collecting plate. The tube(s) inserted into the collars protruding from the outer face of the collecting plate do not project from the inner face. This permits the loss of pressure to be reduced. Thus the greater the number of collars protruding from the outer face of the collecting plate, the greater the reduction in terms of loss of pressure. Preferably, all of the collars protrude from the outer face of the collecting plate, with the exception of the end collars. As a result, the loss of pressure is minimized, only being present in the vicinity of the end tubes.

The collecting plate may also comprise one or more of the following features, taken individually or in combination.

- the collecting plate comprises a peripheral groove designed to receive a seal ring to provide the seal with a cover. The groove is of sufficient depth, for example greater than or equal to the thickness of the gasket, to provide the positioning of the gasket. At least one part of the walls which delimit said groove at the ends of the collecting plate in the direction of a length consists of the end collars. Since these end collars protrude from the inner face of the collecting plate, therefore, this permits the bearing of the peripheral gasket required for the seal of the collecting tank. Thus it is no longer necessary to provide further means for bearing the seal ring, which will increase the loss of pressure and make the manufacture of the collecting plate more complex.
- the plate has a specific thickness, with the exception of the collars which have a reduced thickness relative to the remainder of the collecting plate. Preferably, the reduced thickness corresponds to half of the initial thickness of the collecting plate. More specifically, a small thickness facilitates the piercing and permits the formation of long collars having a large brazing surface.
- the collecting plate has a non-zero curvature in the direction of a length of the collecting plate. In other words, the collecting plate has a non-zero curvature over a longitudinal section. This also means that the collecting plate has at least one ridge or hollow. The presence of a non-zero curvature permits the mechanical strength of the collecting plate to be increased.

since the collars are arranged at regular intervals along the length of said direction so as to define a tube pitch, the maximum amplitude between one collar and another collar adjacent to an end collar is less than said tube pitch.

the amplitude is in the order of said reduced thickness.

a non-zero curvature in the direction of a width of the collecting plate. In other words, the collecting plate has a non-zero curvature over a cross section. Similarly, the curvature permits the mechanical strength of the collecting plate to be increased.

the pitch between two adjacent collars ranges between 5.5 mm and 10 mm, preferably between 6 mm and 8 mm.

A further subject of the invention is an assembly of a collecting plate as disclosed above and tubes, each inserted into a collar of the collecting plate, in which all of the tubes are of the same length.

Apart from the fact that it is more economical to mass-produce identical tubes, the insertion of the tubes in the collecting plate is also simplified since it is not necessary to identify and distribute a tube as a function of its position on the collecting plate. Moreover, in comparison with a collecting plate where all of the collars protrude from the inner face of the collecting plate, the insertion of tubes of the same length into the collecting plate of the invention permits the loss of pressure into the surroundings of the external tubes to be reduced, in particular for plates having a non-zero curvature over a longitudinal section. More specifically, since the collars which are not at the ends are oriented toward the outside of the collecting tank, it is not necessary to introduce the corresponding tubes to such an extent that they project into the inside of the chamber of the collecting tank. Thus the tubes have a reduced length. Since the tubes are of the same length, the length of the part of an end tube which projects into the inside of the chamber is thus also reduced.

The assembly may also comprise one or more of the following features, taken individually or in combination.

each of the tubes inserted into the end collars protrudes from the inner face of the collecting plate, projecting by a length less than or equal to 3 mm of the collar which receives said tube. When the opening of the end collars is not able to be defined on a single plane, for example when it is of concave shape, the length of the part of the tube which protrudes is calculated from the highest point of the opening.

This length is reduced by more than a third relative to that of a tube of a conventional collecting plate. Significant consequences for the loss of pressure are observed.

A further subject of the invention is an assembly of a collecting plate disclosed above and a peripheral seal ring borne by the end collars of the row of collars.

Finally, a further subject of the invention is a heat exchanger comprising an assembly from the two assemblies disclosed above.

Figure 2:
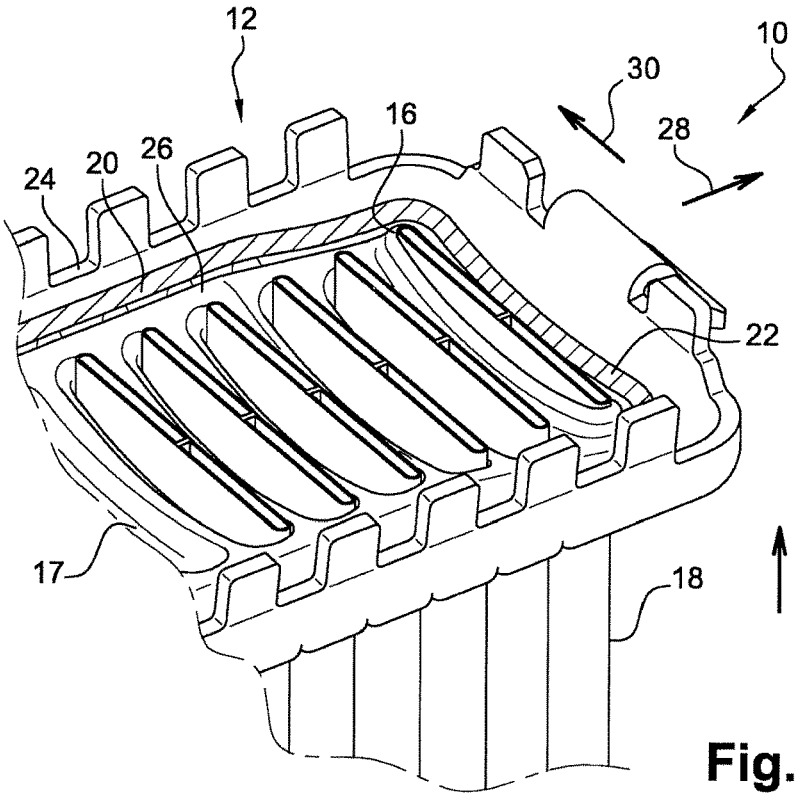
Figure 3:
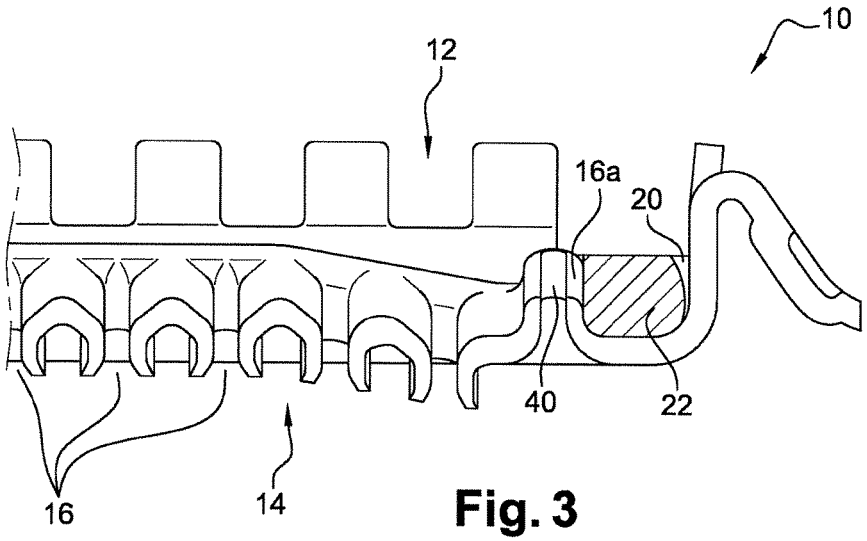
Figure 4:
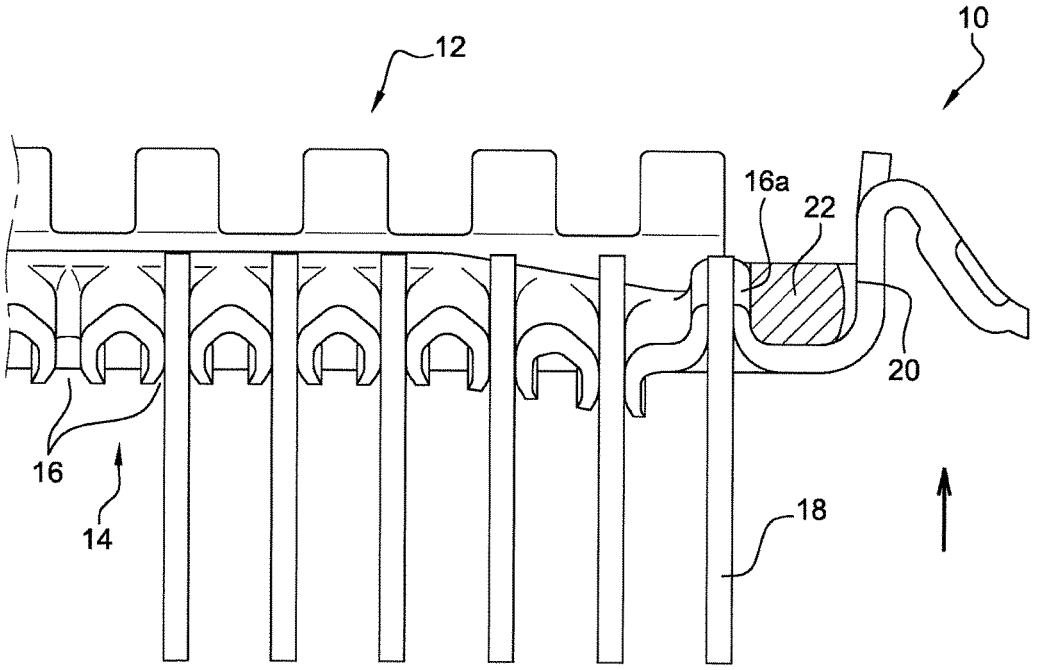
Figure 5:
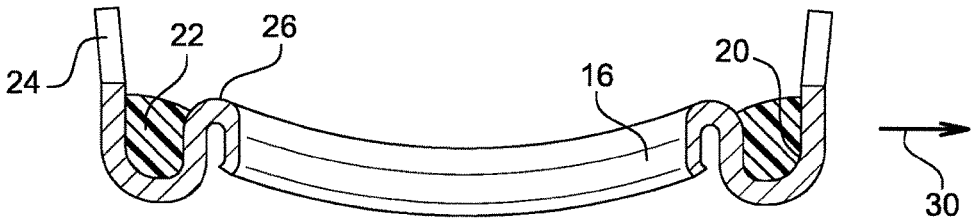
Figure 6:
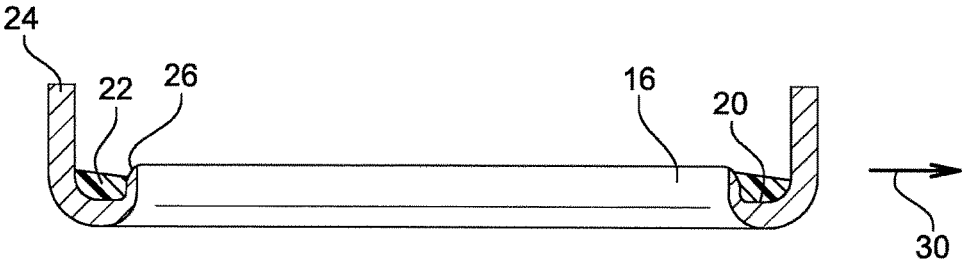
Figure 7:
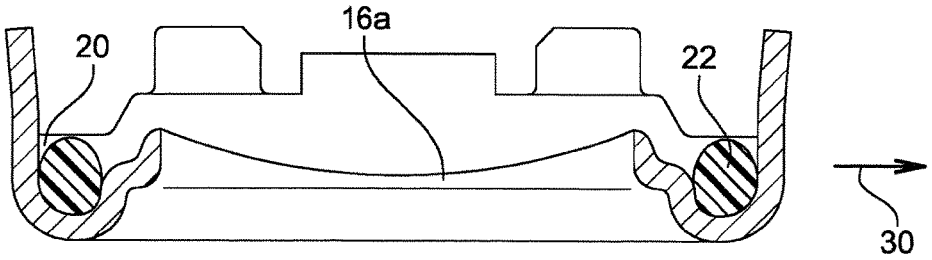

The invention will be understood more clearly by observing the accompanying figures which are provided by way of example and which are of a non-limiting nature, in which:

FIG. 1 is a perspective view of a collecting plate according to an embodiment before the insertion of the tubes, FIG. 2 is a perspective view of the collecting plate of FIG. 1 after the insertion of the tubes, FIG. 3 is a perspective view in longitudinal section of the collecting plate of FIG. 1 before the insertion of the tubes, FIG. 4 is a perspective view in longitudinal section of the collecting plate of FIG. 1 after the insertion of the tubes, FIG. 5 is a perspective view in cross section of a grooved collecting plate with a rounded base according to one embodiment, FIG. 6 is a perspective view in cross section of a flat collecting plate according to one embodiment, and FIG. 7 is a perspective view in cross section of a collecting plate according to one embodiment.

FIGS. 1 to 4 show a collecting plate 10 of generally rectangular shape, having an inner face 12 and an outer face 14, of a heat exchanger comprising a plurality of collars 16, 16*a* around the holes 17. The collars are arranged in a row so that each collar receives a tube 18. The two end collars 16*a* of the row of collars protrude from the inner face 12 of the collecting plate 10, whilst at least one other of the collars 16 protrudes from the outer face 14 of the collecting plate 10. In the figures, all of the collars 16 protrude from the outer face, with the exception of the end collars 16*a*. The collecting plate 10 comprises a peripheral groove 20 designed to receive a seal ring 22 to provide the seal with a cover. The groove 20 is sufficiently deep to receive the gasket 22 and to provide its stability. Said groove is delimited by an external wall 24 and a raised portion 26 protruding in the direction 28 of the length of the collecting plate. However, at the ends of the collecting plate 10, the groove 20 is delimited by the external wall 24 and the end collars 16*a*. Thus the gasket 22 ultimately bears against the raised portion 26 and the external walls of the end collars 16*a*.

The collecting plate 10 is curved in the longitudinal direction 28. Over a longitudinal section, as for example that of FIG. 3, the collecting plate has a shape which is generally convex at the center and concave at the ends, such that at the center the portion between two adjacent collars 16 is offset by a distance in the order of the thickness of the material in the region of these portions (specific thickness) relative to an equivalent portion located between a collar 16 and an end collar 16*a*. In embodiments which are not shown, this distance or amplitude of curvature may be different, smaller or greater, but less than the distance corresponding to the tube pitch.

The collecting plate is also curved in the transverse direction 30. Over a cross section, such as for example that of FIG. 5, the collecting plate is concave in the center and has raised edges, until the walls of the raised portion 26 are formed. In further embodiments, as those of FIGS. 6 and 7, the collecting plate may be generally flat in the direction 30. The presence of a curvature in one or more directions permits the mechanical strength of the collecting plate to be reinforced and the formation of collars to be facilitated.

In the longitudinal direction 28, the plate has alternating solid portions and collar portions 16 such that in cross section it has corrugations (FIG. 3, FIG. 4). These corrugations have a pitch which corresponds to the pitch between two adjacent collars 16 or between a collar 16 and an end collar 16*a*. This pitch is constant and ranges between 5.5 mm and 10 mm, preferably between 6 mm and 8 mm.

Each of the tubes 18 inserted into a collar 16, 16*a* of the collecting plate is substantially of the same length as the other inserted tubes. Due to the curvature of the plate 10 in the direction 28 and since the collars 16 protrude from the outer face 14, the end tubes project less from the inner face 12. Each of these end tubes protrudes from the inner face 12, projecting by a length less than or equal to 3 mm from the collar 16*a* which receives it. As the aperture 40 of the collars 16*a* is not flat, the projection is measured from the highest point to the center of the opening of the collar.

The collecting plate comprises at least one zone where the thickness is reduced, preferably the thickness being reduced by up to half of the initial thickness of the plate. This zone comprises the location for piercing one or more collars 16, 16*a* and is thus located around these collars.

The assembly of the collecting plate 10 and the row of tubes 18 is then covered by a cover to form a closed chamber of a collecting tank, the seal thereof being ensured by the gasket 22. The collecting tank is then mounted in a heat exchanger supplied with one or more fluids.

The invention is not limited to the embodiments shown and further embodiments will appear clearly to the person skilled in the art. In particular, it is possible to combine the different disclosed embodiments, in particular producing therefrom a collecting plate having a curvature only in a single direction or even a collecting plate having a plurality of rows of collars.

The invention claimed is:

1. A collecting plate having an inner face and an outer face of a heat exchanger, comprising:

at least three collars arranged in a row so that each collar receives a tube, wherein two end collars of the row of at least three collars protrude from the inner face of the collecting plate, and at least one of remaining collars of the at least three collars protrudes from the outer face of the collecting plate, and wherein external walls of the two end collars partially delimit a peripheral groove for receiving a seal ring.

2. The collecting plate as claimed in claim 1, wherein said plate has a specific thickness, with the exception of the collars which have a reduced thickness relative to the remainder of the collecting plate.

3. The collecting plate as claimed in claim 2, having a non-zero curvature in a direction of a length of the collecting plate.

4. The collecting plate as claimed in claim 3, wherein since the at least three collars are arranged at regular intervals along the length of said direction so as to define a tube pitch, the maximum distance between at least one of the remaining collars and another collar adjacent to one of the two end collars is less than said tube pitch.

5. The collecting plate as claimed in claim 3, wherein said amplitude is in the order of said specific thickness.

6. The collecting plate as claimed in claim 1, having a non-zero curvature in the direction of a width of the collecting plate.

7. The collecting plate as claimed in claim 1, wherein the pitch between two adjacent collars is constant and ranges between 6 mm and 8 mm.

8. An assembly, comprising:

a collecting plate having an inner face and an outer face of a heat exchanger, wherein the collecting plate comprises at least three collars arranged in a row; and tubes inserted into each collar of the row of at least three collars of the collecting plate, wherein two end collars of the row of at least three collars protrude from the inner face of the collecting plate, and at least one of remaining collars of the at least three collars protrudes from the outer face of the collecting plate, wherein external walls of the two end collars partially delimit a peripheral groove for receiving a seal ring, and wherein all of the tubes are of a same length.

9. The assembly as claimed in claim 8, wherein each of the tubes inserted into two end collars protrudes from the inner face of the collecting plate, projecting by a length less than or equal to 3 mm of a corresponding collar which receives said tube.

10. A heat exchanger comprising a collecting plate having an inner face and an outer face of a heat exchanger, wherein the collecting plate comprises at least three collars arranged in a row; and tubes inserted into each collar of the row of at least three collars of the collecting plate, wherein two end collars of the row of at least three collars protrude from the inner face of the collecting plate, and at least one of remaining collars of the at least three collars protrudes from the outer face of the collecting plate, wherein external walls of the two end collars partially delimit a peripheral groove for receiving a seal ring, and wherein all of the tubes are of a same length.

11. The collecting plate as claimed in claim 1, wherein collecting plate is capped by a cover to form a collecting tank comprising a chamber traversed by a fluid that circulates in the row of tubes attached to the at least three collars.

12. The collecting plate as claimed in claim 11, wherein a peripheral gasket is arranged between the collecting plate and the cover to provide a seal of the collecting tank, and wherein the seal ring provides the seal with a cover.

13. The collecting plate as claimed in claim 12, wherein the peripheral groove comprises depth to receive the peripheral gasket.

* * * * *